US007972074B2

(12) United States Patent
Lepage

(10) Patent No.: US 7,972,074 B2
(45) Date of Patent: Jul. 5, 2011

(54) LEVELING TOOL FOR APPLYING FLUENT MATERIAL

(76) Inventor: Daniel Lepage, Magog (CA)

( * ) Notice: Subject to any disclaimer, the term of this patent is extended or adjusted under 35 U.S.C. 154(b) by 262 days.

(21) Appl. No.: 11/874,865

(22) Filed: Oct. 18, 2007

(65) Prior Publication Data

US 2008/0095570 A1 Apr. 24, 2008

Related U.S. Application Data

(60) Provisional application No. 60/852,613, filed on Oct. 18, 2006.

(51) Int. Cl.
*B05C 11/00* (2006.01)

(52) U.S. Cl. ..... 401/266; 15/235.7

(58) Field of Classification Search ..... 401/266, 401/265, 9; 15/105, 105.5, 236.01, 245.1, 15/235.3–235.8, 236.05; 425/458, 87, 45, 425/878; D8/45

See application file for complete search history.

(56) References Cited

U.S. PATENT DOCUMENTS

| | | | | |
|---|---|---|---|---|
| 3,744,079 | A | 7/1973 | Krause | |
| 3,761,992 | A | 10/1973 | Schneller | |
| 3,846,060 | A * | 11/1974 | Otis | 425/458 |
| 4,586,890 | A | 5/1986 | Marchbanks | |
| 5,017,113 | A * | 5/1991 | Heaton et al. | 401/266 |
| 5,018,956 | A * | 5/1991 | Lemaster | 425/87 |
| 5,440,776 | A | 8/1995 | Kartler | |
| 5,471,704 | A * | 12/1995 | Woolley | 15/235.7 |
| 5,622,728 | A * | 4/1997 | Kartler | 425/458 |
| 5,675,860 | A | 10/1997 | Campbell | |
| 6,035,536 | A | 3/2000 | Dewberry | |
| 6,219,878 | B1 | 4/2001 | Dewberry | |
| 6,450,723 | B1 * | 9/2002 | Lithgow | 401/266 |
| 6,578,229 | B1 | 6/2003 | Dziallas | |
| 6,880,198 | B1 * | 4/2005 | Hazard | 15/235.7 |
| 7,127,769 | B2 | 10/2006 | Chang | |
| 7,908,702 | B2 * | 3/2011 | Accumanno | 15/235.7 |

* cited by examiner

*Primary Examiner* — David J. Walczak
*Assistant Examiner* — Jennifer Chiang

(57) ABSTRACT

A leveling tool having a body which consists of a handle part and a leveling part. The leveling part being generally pointed in shape by way of two converging plows.
An apex formed by the convergence of the converging plows.
An exit located at the apex.

17 Claims, 7 Drawing Sheets

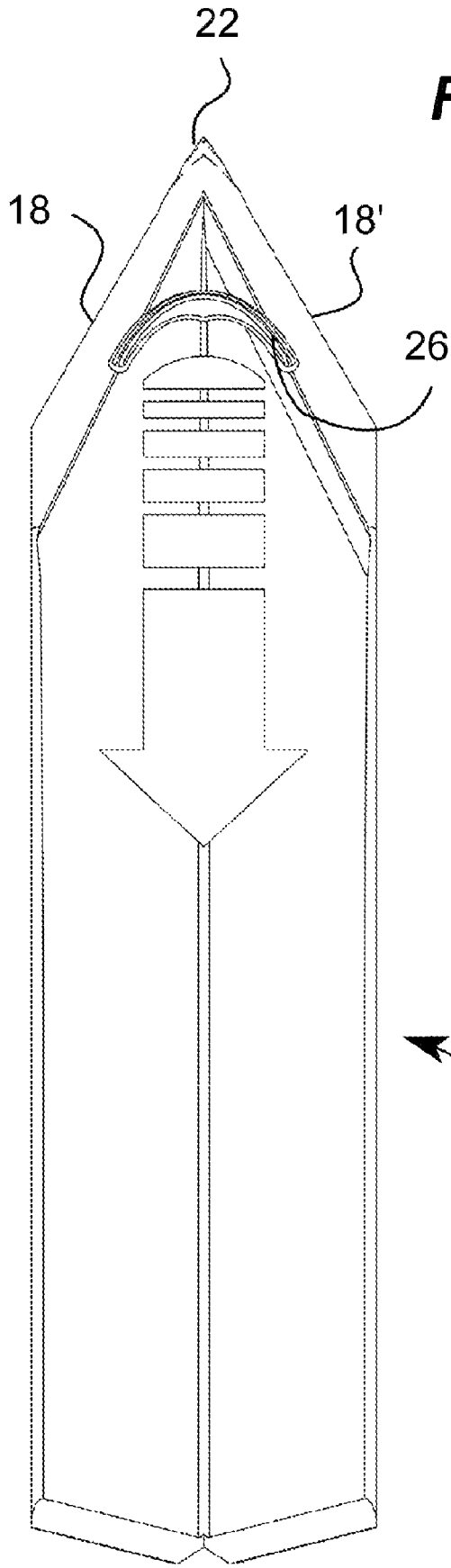
FIG. 2a
FIG. 2b
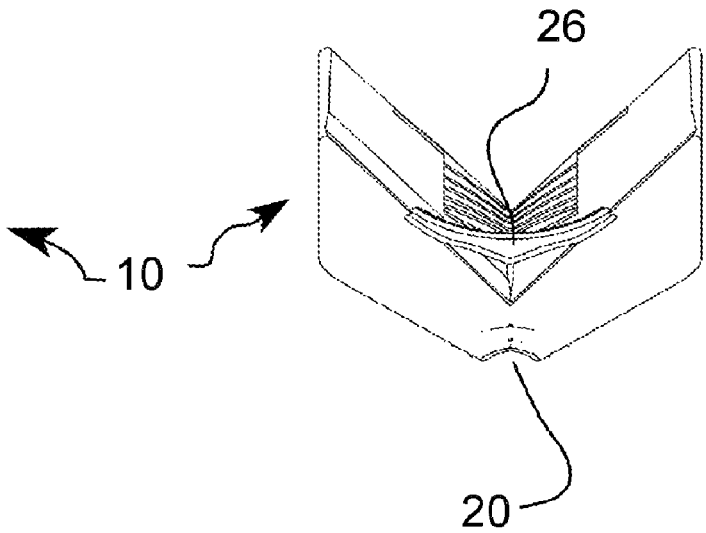

FIG. 9a
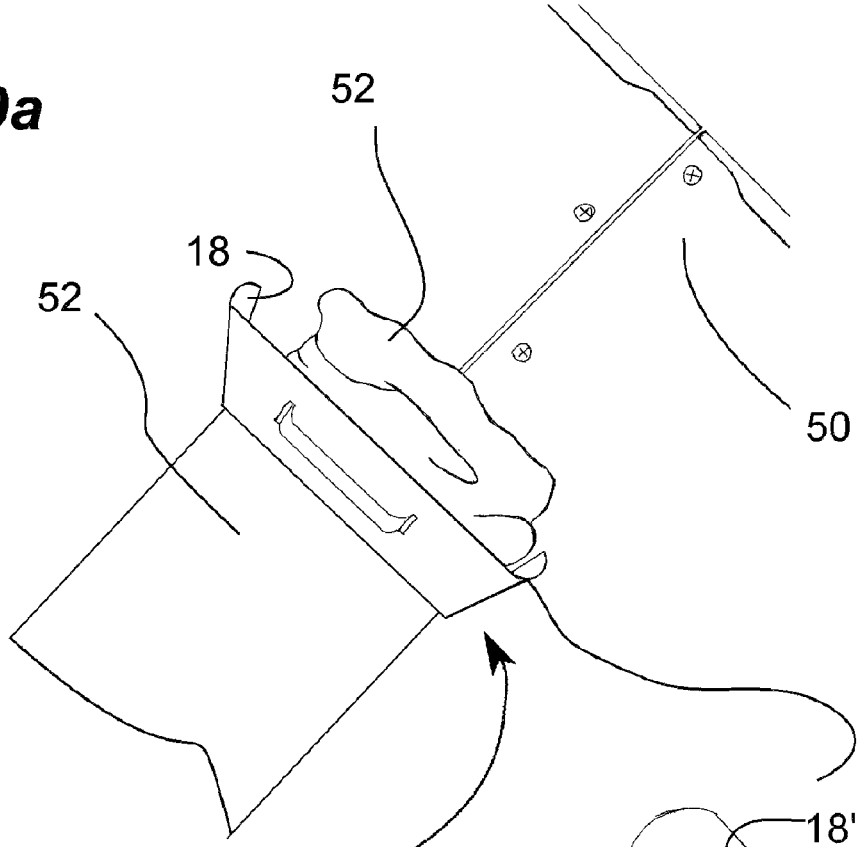
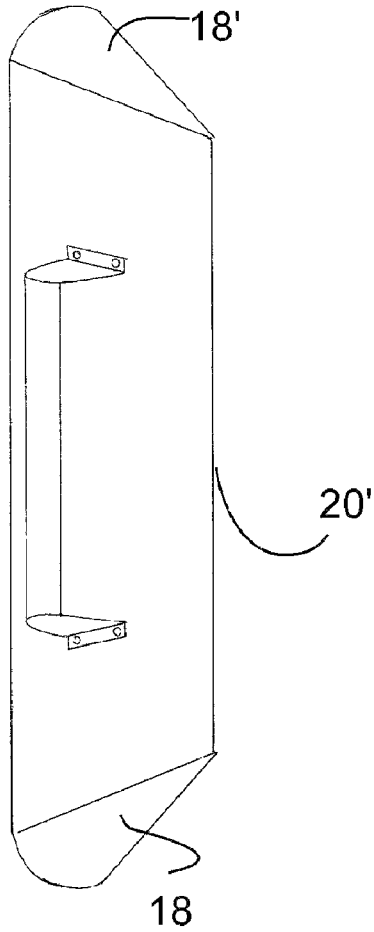
FIG. 9b

LEVELING TOOL FOR APPLYING FLUENT MATERIAL

This application claims priority based on provisional No. 60/852,613 filed Oct. 18, 2006

FIELD OF THE INVENTION

The present invention relates generally to hand tools but more particularly to a leveling tool for applying fluent material

BACKGROUND OF THE INVENTION

Caulking, putty, silicone, and other such fluent material are used for sealing various joints. The general terminology used is "caulking" and most of the time, its primary use, in residential settings, is either around a bathtub or other surfaces where water is present such as counter tops. Other uses can be around external windows to prevent water and moisture from getting inside the dwelling and cause damage. Caulking is not easy to apply in an even strip, especially for untrained hobbyist or anyone who does not get to apply caulking on a regular basis. Because caulking joints are sometimes applied to highly visible areas where aesthetic is of a concern, applying it cleanly is a must.

In order to solve this problem, inventors have developed a variety of tools to help in that unforgiving task:

In one invention, a tool provided with a V-shaped cross-sectional configuration made of two integrally connected flanges of resilient semi-soft material disposed at a larger than 90.degree. angle from one another so that forced insertion between said two walls produces a seal-tight connection between walls and flanges for removal of excess caulking material and for pressing of the caulking material in the seam. The tool is pushed forward so that an approximate 45.degree. evenly-pressed and smoothed bead of caulking material remains when the tool is moved between the walls over the approximately disposed caulking material at the seam.

In yet another invention, a hand tool including a handle and a working head, the head being essentially a thick, flat square piece of rubber like material with one corner affixed to the handle and an opposite corner, slightly rounded, directed away from the handle.

A hand held elongated flexible tool having a first end which is used for uniformly compressing and contouring of a bead of caulk, grout, putty, or other fluent material. The opposite end of the tool is then used to remove excess fluent material from the sides of the contoured bead. In a preferred form, the contouring end of the tool contains at least one concavity extending longitudinally from an extremity of that end and partially along one side of the tool.

A glazing tool which has a handle plate to be gripped between the thumb and forefinger of an operator. Two spaced trim blades have runner edges disposed at an angle to handle plates to trim the bead of glazing material. These runner edges angle toward the distal end of the back plate where a bead contact blade is disposed transversely of the runner edges. Perforate side wings proximal to the bead contact blade rise upwardly and outwardly of the trim blades to guide trimmed glaze material away from the tool.

An applicator tool for applying cementitious materials such as joint compound to corners. The tool has a handle and a head which is curved. A flexible elastomeric blade projects from the forward edge of the head to smooth the compound.

A one-piece molded corner cap in a general trihedral shape is provided and when using the tool results in a smooth, uniform finished corner.

A hand held applicator tool adapted to work a mass of filler material into a gap to form a seal between two pieces. The tool includes a handle having attached thereto a tapered head defined by tapered lateral side edges thereof which cooperate to define a tip as well as a working surface. The head being upturned in the area adjacent the tip and including a rim margin adjacent the side edges and the tip wherein the rim margin is made of a flexible and resilient material.

A hand held tool for the uniform compressing, forming and simultaneous cleaning of a previously applied bead of caulking or other similar fluent material from a constructed joint. The tool includes an elongated handle and triangular head with working edges, the working edges being essentially an arrow-like shaped pieced or rubber-like material fixed to and extending slightly beyond the acute isosceles triangular shaped head portion of the tool at the extremity opposite an elongated handle, the acute angle of the working edges at the extremity is slightly rounded. The head and the handle contain a continuous longitudinal cavity provided for the collection of excess material gathered during the operation of the tool and in the preferred embodiment the head and handle are essentially molded as one unit in resilient plastic material with the handle expanding in a fan-like shape at the outer angles of the head.

A hand held tool specifically for the removal of a cured bead of caulk, sealant or other previously fluent material from a joint between substantially perpendicular surfaces. The tool comprises an elongate handle with two working heads. The primary working head at one end of the longitudinal axis of the handle features a chisel-like point angled down from the upper face of the handle and extending between two symmetrical flanking planes which are acutely angled to each other and also spread from the body of the handle. The planes are beveled to form sharp edges for scraping surfaces during an operation to remove a bead whilst the chisel-like point chisels the body of the bead from the joint. Axially opposite the primary head the second working head is essentially an angled chisel-like point extended from the upper face of the handle and is used to chisel, pick or gouge a bead from a joint.

Another device for removing a cured bead of caulk, sealant or other previously fluent material, and a method of using the same. The device includes a body member and a peeling element located adjacent to the front end of the body member. The peeling element includes at least two peeling points, where the first peeling point is located proximate to the topside of the peeling element and the second peeling point is located proximate to the underside of the peeling element. The device also includes an opening located between the peeling element and body member.

SUMMARY OF THE INVENTION

It is a main advantage of this invention to provide for an efficient and easy to use hand tool that makes a clean line of caulking.

In order to do so, the invention comprises a body which consists of a handle part and a leveling part. The leveling part being generally pointed in shape by way of two converging plows. An apex formed by the convergence of the converging plows, an exit located at said apex.

The leveling tool can also have a finger rest forming an integral part of the leveling part.

In an alternate embodiment, the leveling tool can have a resiliently articulated joint located at the intersection between the leveling part and the handle part.

In another embodiment, a pivotally attached articulated joint pivotally attached to the leveling part.

In yet another embodiment, the leveling part is fixedly attached to a caulking tube adapter wherein the caulking tube adapter is configured and sized to fit over the tip of a caulking tube.

In still another embodiment, the tool can also be used for laying plaster for drywall joints wherein instead of an exit hole there is an exit slit.

The leveling tool has a method of use consisting in the steps of having a user first applies a line of caulking (or any other fluidic material) as is known in the art, the user presses the leveling tool so that each plow makes contact with the surface. Once contact is made, the user slides the leveling tool in a direction opposite the exit hole, thus leveling the line.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

BRIEF DESCRIPTION OF THE DRAWINGS

FIG. 2*a* Top view of the invention.

FIG. 2*b* Front view of the invention

FIG. 9*ab* Isometric and front view of yet another variation.

DETAILED DESCRIPTION

Figure 1:
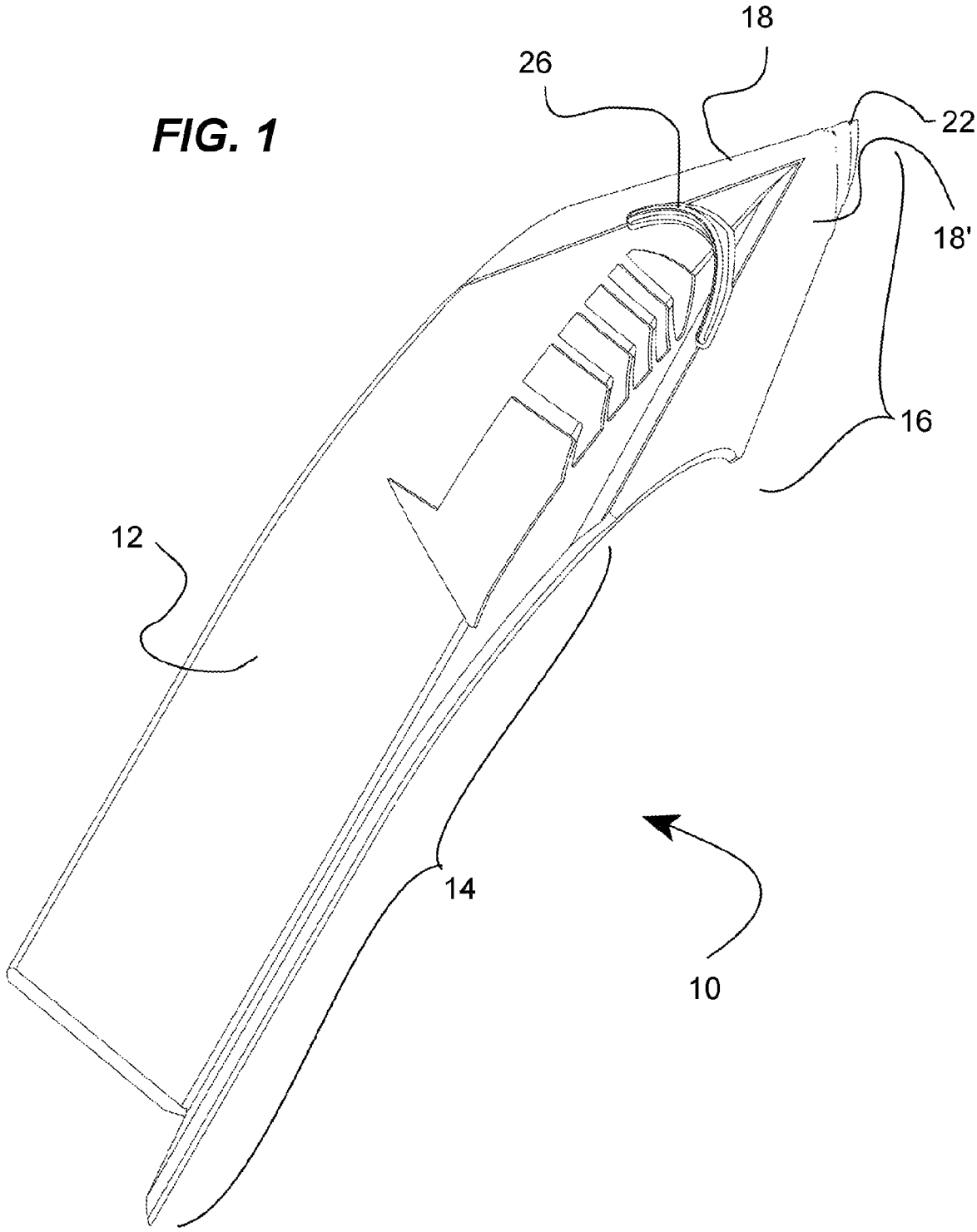
FIG. 1 Isometric view of the invention.
Figure 3:
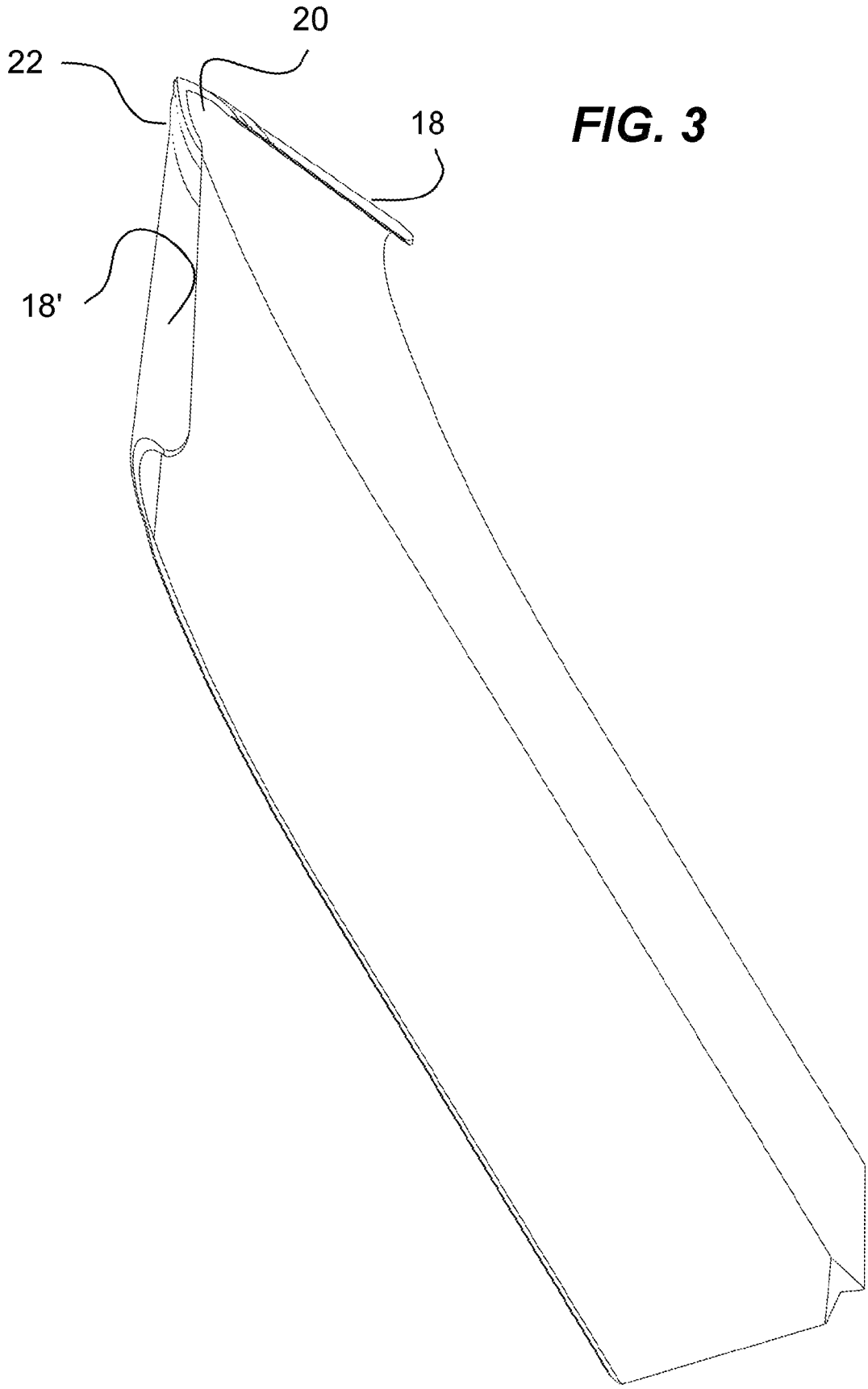
FIG. 3 Bottom isometric view of the invention.
Figure 4:
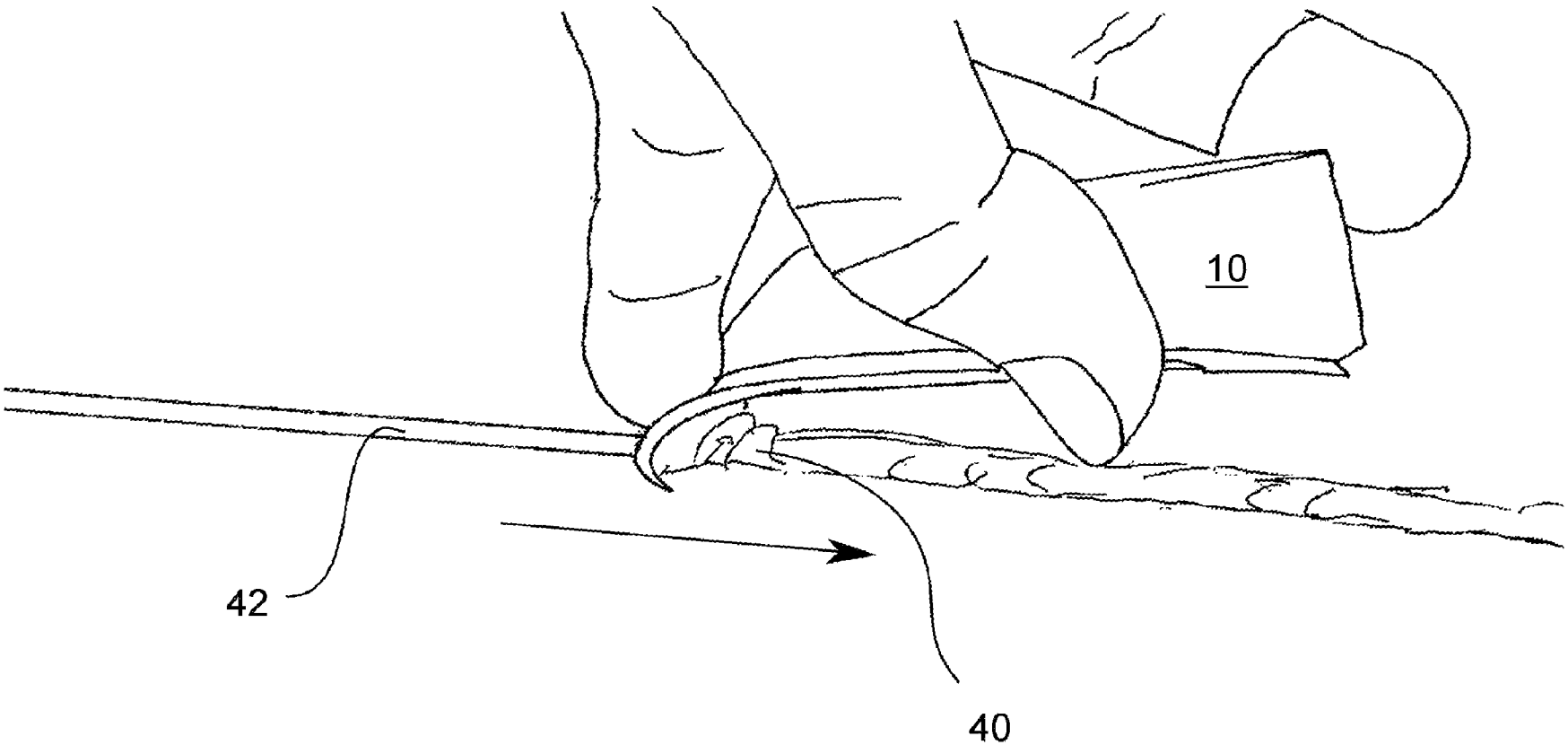
FIG. 4 Isometric view of the invention in use.
Figure 5:
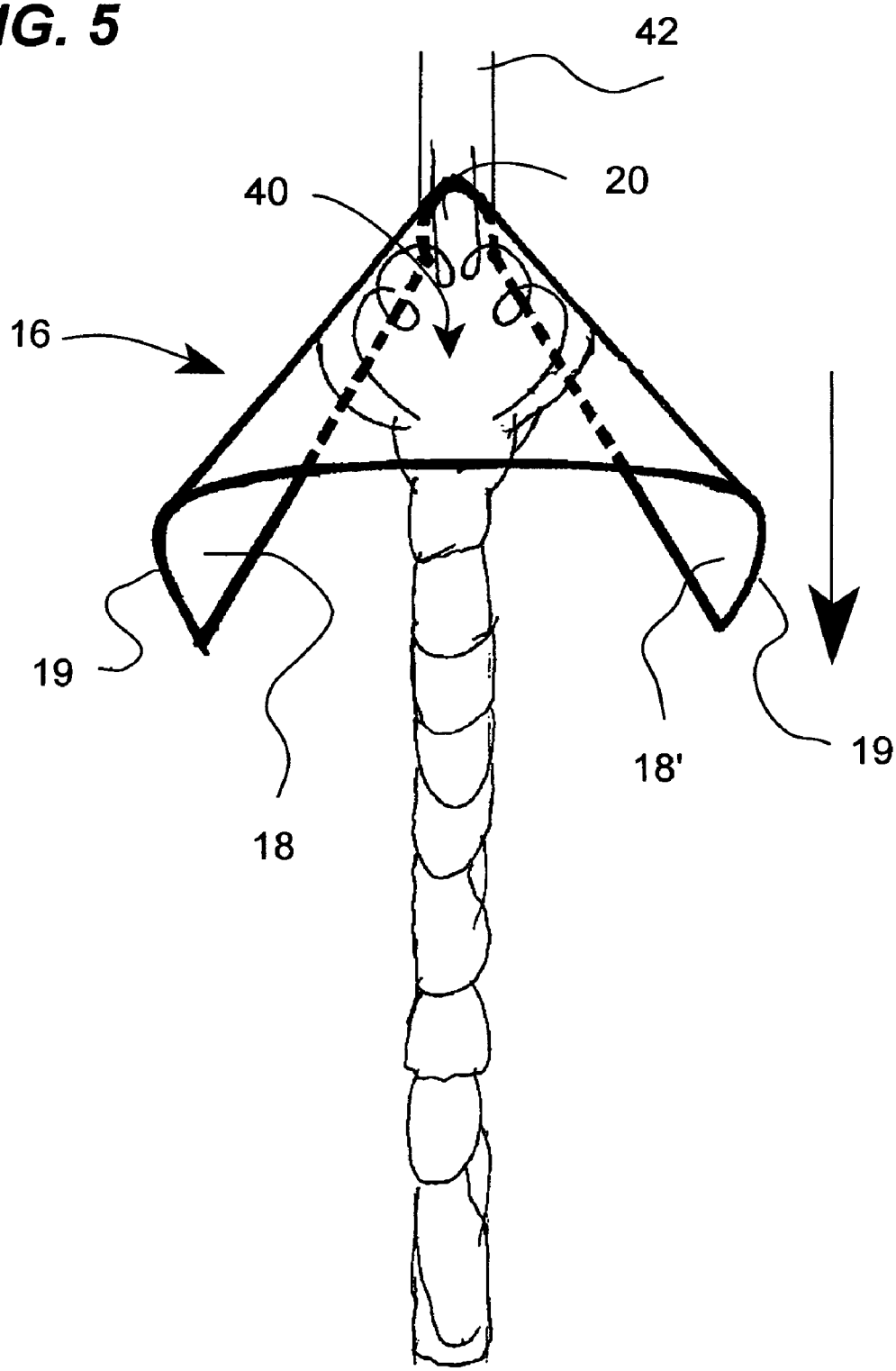
FIG. 5 Isometric see through view illustrating the work of the plow.

A leveling tool (10) for fluidic material has a body (12) which consists of a handle part (14) and a leveling part (16). The leveling part (16) is generally pointed in shape and consists of two converging plows (18, 18'). The body (12) forms an elongated shape which defines a longitudinal axis running along the length of it. Dragging the caulking leveling tool (10) across a freshly applied line of caulking funnels the caulking, by way of the plows (18, 18'), towards an exit hole (20) located at an apex point (22) where both plows (18, 18') meet to form the exit hole (20). Doing so insures a uniform line of caulking with the excess caulking curling up on the plows (18, 18') for easy removal afterwards. A finger rest (26) can also be optionally added at the leveling part (16). The finger rest (26) is very useful in helping a finger of a user to frictionally hold and drag theid leveling tool along a line of fluidic material. The plows (18, 18') each have two ends: A proximal end which extend from the exit hole (20), and a distal end located opposite the exit hole (20) and which has a curve (19). Both curves (19) face each other. Each curve (19), as best seen in FIG. 5, faces the other curve (19) from across the longitudinal axis defined by the body's (12) length. Each curve (19) forms an integral part of the leveling part (16) which forms an imaginary line that crosses perpendicularly across the line of caulking (42) so as to connect both curves (19).

To better illustrate how the plows (18, 18') work, FIG. 5 shows a see through view wherein excess caulking (40) is gathered up by each plow (18, 18") in a manner not unlike a snow plow. Any excess is contained within the region of convergence of the plows (18, 18'). Any time the caulking line (42) is less than the minimal required for a clean line, the excess caulking (40) in reserve passes through the exit hole (20) and equalizes the line (42).

Using the same key parts, that is, the leveling part (16) and the two converging plows (18, 18'), variations in the embodiment are possible, all within the scope of the invention.

Figure 6:
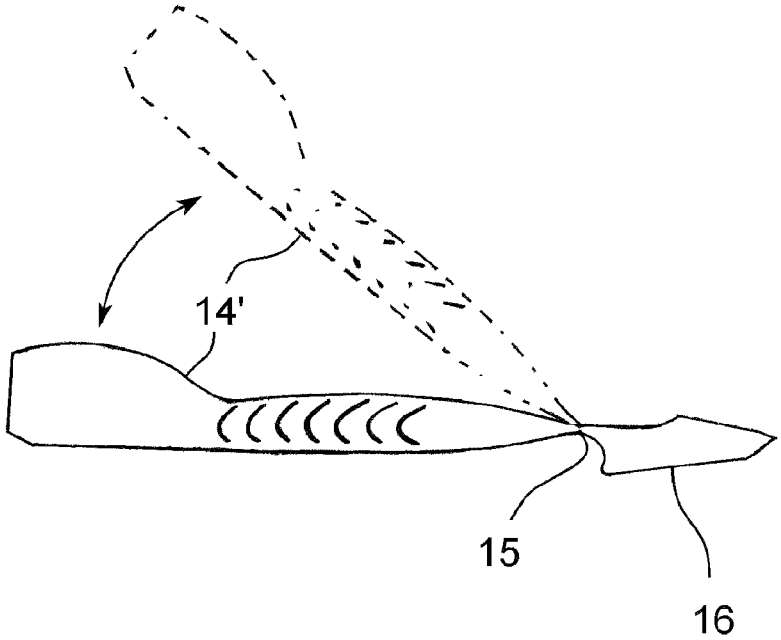
FIGS. 6-8 Isometric views of variations of the invention.

In one such embodiment, there is a resiliently articulated joint (15) located at the intersection between the leveling part (16) and the handle part (14). This flexible handle part (14'), as seen in FIG. 6 allows for the leveling tool (10) to be used all the way into wall corners by bending the handle.

Figure 7:
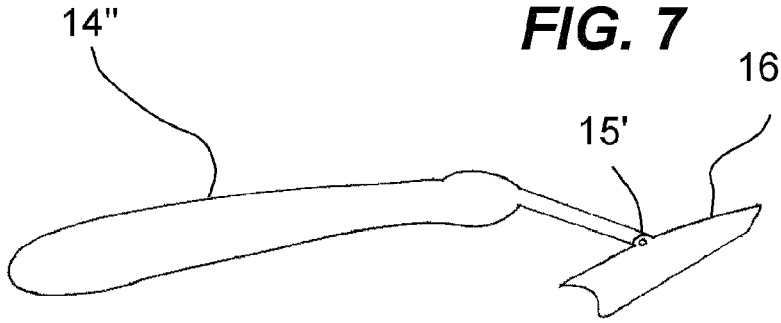
Figure 8:
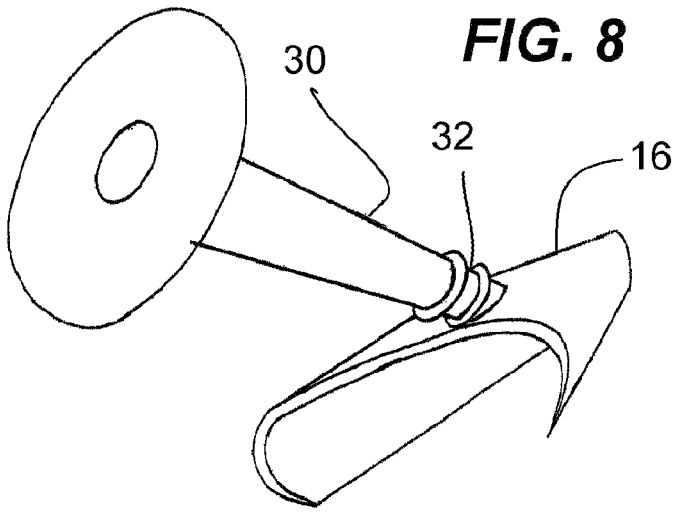

In another embodiment, as seen in FIG. 7, a pivotally attached articulated joint (15') is pivotally attached to the leveling part (16). This variation also allows for the leveling tool (10) to be used all the way into wall corners.

In yet another embodiment, the leveling part is fixedly attached to a caulking tube adapter (30). The caulking tube adapter (30) is configured and sized to fit over the tip of a caulking tube (not shown) and has a flexible joint (32).

In still another embodiment, the leveling tool (10) can also be used for laying plaster (50) for drywall joints (52) as seen in FIG. 9Ab wherein instead of an exit hole (20) there is an exit slit (20'). The leveling tool (10) is used in the same way but for a different application.

In order to use the leveling tool (10), a user first applies a line of fluidic as is known in the art. Then, the user presses the leveling tool (10) so that each plow (18, 18') makes contact with a surface, where the line (42) is applied. Once contact is made, the user slides the leveling tool (10) in a direction opposite the exit hole (20), thus leveling the line (42).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A leveling tool for fluidic material comprising a body consisting of a handle part and a leveling part; said body forms an elongated shape which defines a longitudinal axis running along the length of said body; said leveling part being generally pointed in shape and including two converging plow members, wherein each plow member has a curved surface to accumulate and move said fluidic material, and an exit hole located at an apex point between said converging plow members; such that said leveling part smoothes a predetermined amount of fluidic material through said exit hole into a caulk line while accumulating and moving an excess portion of said fluidic material outward and away from a centerline of said handle part toward said curved surface of each plow member; said plow members each have a proximal end which extend from said exit hole and a distal end located opposite said exit hole thereby forming an edge, each edge has a curve and each said curve face each other from across said longitudinal axis of said body's length, and each said curve forming an integral part of said leveling part and said leveling part forming a line crossing perpendicularly across said line of caulking so as to connect both said curves.

2. The leveling tool of claim 1, wherein said exit hole has a curved surface which forms a curved profile upon said predetermined amount of fluidic material in said caulk line.

3. The leveling tool of claim 1, wherein said exit hole has an elongated rectangular surface forming an exit slit which forms a rectangular profile upon said predetermined amount of fluidic material in said caulk line.

4. The leveling tool of claim 1, wherein said handle part further includes a finger rest having a series of ridges to allow a finger of a user to frictionally hold and drag said leveling tool along a line of fluidic material.

5. The leveling tool of claim 1, further comprising a resilient joint located between said handle part and said leveling part to allow said leveling tool to be bent at different desired angles and thereby fit into different types types of corners formed by abutting walls.

6. The leveling tool of claim 1, further comprising a flexible handle part located between said handle part and said leveling part to allow said leveling tool to be bent at different desired angles and thereby fit into different types of corners formed by abutting walls.

7. A leveling tool for fluidic material comprising a body consisting of a caulking tube adapter and a leveling part; said leveling part being generally pointed in shape and including an aperture at a to surface of said leveling part for connection to said tube adapter; two converging plow members, wherein each plow member has a curved surface to accumulate and move said fluidic material, and an exit hole located at an apex point between said converging plow members; said caulking tube adapter removably connects with a caulking tube on one end and said aperture of said leveling part on an opposite end, thereby allows fluidic material to pass therethrough and into said leveling part, which smoothes a predetermined amount of fluidic material through said exit hole into a caulk line while accumulating and moving an excess portion of said fluidic material outward and away from a centerline of said leveling part toward said curved surface of each plow member; said plow members each have a proximal end which extend from said exit hole and a distal end located opposite said exit hole thereby forming an edge, each edge has a curve and each said curve face each other from across a longitudinal axis of said leveling part, and each said curve forming an integral part of said leveling part and said leveling part forming a line crossing perpendicularly across said line of caulking so as to connect both said curves.

8. The leveling tool of claim 7, wherein said exit hole has a curved surface which forms a curved profile upon said predetermined amount of fluidic material in a caulk line.

9. The leveling tool of claim 7, wherein said exit hole has an elongated rectangular surface forming an exit slit which forms a rectangular profile upon said predetermined amount of fluidic material in a caulk line.

10. The leveling tool of claim 7, further comprising a resilient joint located between said caulking tube adapter and said leveling part to allow said leveling tool to be bent at different desired angles and thereby fit into different types of corners formed by abutting walls.

11. The leveling tool of claim 7, further comprising a flexible portion located between said caulking tube adapter and said leveling part to allow said leveling tool to be bent at different desired angles and thereby fit into different types of corners formed by abutting walls.

12. A method of applying and removing excess fluidic material to abutting surfaces of construction material comprising the steps of:

a.) applying a bead of said fluidic material along a portion of a joint formed by said abutting surfaces of construction material;

b.) providing a leveling tool comprising a body consisting of a handle part and a leveling part; said body forms an elongated shape which defines a longitudinal axis running along the length of said body; said leveling part being generally pointed in shape and including two converging plow members, wherein each plow member has a curved surface to accumulate and move said fluidic material, and an exit hole located at an apex point between said converging plow members, such that said leveling part smoothes a predetermined amount of fluidic material through said exit hole into a caulk line while accumulating and moving an excess portion of said fluidic material outward and away from a centerline of said handle part toward said curved surface of each plow member; said plow members each have a proximal end which extend from said exit hole and a distal end located opposite said exit hole thereby forming an edge, each edge has a curve and each said curve face each other from across said longitudinal axis of said body's length, and each said curve forming an integral part of said leveling part and said leveling part forming a line crossing perpendicularly across said line of caulking so as to connect both said curves;

c.) pressing said leveling tool such that each plow member makes contact with respective abutting surfaces of said construction material and said fluidic material;

d.) then sliding said leveling tool in a direction opposite from said exit hole in order to level said bead of fluidic material while removing excess fluidic material.

13. The method of applying and removing excess fluidic material of claim 12, wherein said exit hole has a curved surface which forms a curved profile upon said predetermined amount of fluidic material in a caulk line.

14. The method of applying and removing excess fluidic material of claim 12, wherein said exit hole has an elongated rectangular surface forming an exit slit which forms a rectangular profile upon said predetermined amount of fluidic material in a caulk line.

15. The method of applying and removing excess fluidic material of claim 12, wherein said handle part further includes a finger rest having a series of ridges to allow a finger of a user to frictionally hold and drag said leveling tool along a line of fluidic material.

16. The method of applying and removing excess fluidic material of claim 12, further comprising a resilient joint located between said handle part and said leveling part to allow said leveling tool to be bent at different desired angles and thereby fit into different types of corners formed by abutting walls.

17. The method of applying and removing excess fluidic material of claim 12, further comprising a flexible handle part located between said handle part and said leveling part to allow said leveling tool to be bent at different desired angles and thereby fit into different types of corners formed by abutting walls.

* * * * *